US009634368B2

(12) United States Patent
Okubo

(10) Patent No.: US 9,634,368 B2
(45) Date of Patent: Apr. 25, 2017

(54) NON-RECIPROCAL CIRCUIT ELEMENT

(71) Applicant: Murata Manufacturing Co., Ltd., Kyoto (JP)

(72) Inventor: Daisuke Okubo, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 15/142,423

(22) Filed: Apr. 29, 2016

(65) Prior Publication Data

US 2016/0240906 A1 Aug. 18, 2016

Related U.S. Application Data

(63) Continuation of application No. PCT/JP2014/075158, filed on Sep. 24, 2014.

(30) Foreign Application Priority Data

Nov. 29, 2013 (JP) ..... 2013-247325

(51) Int. Cl.
*H01P 1/383* (2006.01)
*H01P 1/36* (2006.01)

(52) U.S. Cl.
CPC ..... *H01P 1/383* (2013.01); *H01P 1/36* (2013.01)

(58) Field of Classification Search
CPC ..... H01P 1/38; H01P 1/383
(Continued)

(56) References Cited

U.S. PATENT DOCUMENTS 6,215,371 B1 * 4/2001 Kurahashi ..... H01P 1/387 333/1.1
8,130,054 B1 * 3/2012 Martin ..... H01P 1/20 333/1.1

(Continued)

FOREIGN PATENT DOCUMENTS

JP 2008-085981 A 4/2008
JP 2008-109391 A 5/2008

(Continued)

OTHER PUBLICATIONS

International Search Report issued in Application No. PCT/JP2014/075158 dated Jan. 6, 2015.

(Continued)

*Primary Examiner* — Stephen E Jones
(74) *Attorney, Agent, or Firm* — Pearne & Gordon, LLP

(57) ABSTRACT

In a non-reciprocal circuit element, the characteristics variation with respect to temperature is suppressed with a simple configuration without changing a magnetic material or the material of a magnet. A non-reciprocal circuit element includes: a magnetic material (32) to which a DC magnetic field (G) is applied; a plurality of center electrodes (35, 36) disposed on the magnetic material (32) so as to intersect each other in an insulated state; a terminal resistor (R) connected between input and output ports (P1, P2) and in in parallel with one of the center electrodes (35, 36); a variable capacitance element (C11) connected between the input and output ports (P1, P2) and in parallel with the terminal resistor (R); and a thermistor element (S) connected to a control power supply circuit (E) of the variable capacitance element (C11) and in series with the variable capacitance element (C11).

10 Claims, 8 Drawing Sheets

(58) Field of Classification Search
USPC ..... 333/1.1, 24.2
See application file for complete search history.

(56) References Cited

U.S. PATENT DOCUMENTS

| | | | |
|---|---|---|---|
| 2008/0309426 | A1 | 12/2008 | Furuta |
| 2013/0147574 | A1 | 6/2013 | Wada |
| 2014/0340166 | A1 | 11/2014 | Wada |

FOREIGN PATENT DOCUMENTS

| | | | |
|---|---|---|---|
| JP | 2011-055222 | A | 3/2011 |
| JP | 2013-145945 | A | 7/2013 |
| WO | 2012/020613 | A1 | 2/2012 |
| WO | 2013/118355 | A1 | 8/2013 |

OTHER PUBLICATIONS

Written Opinion issued in Application No. PCT/JP2014/075158 dated Jan. 6, 2015.

* cited by examiner

NON-RECIPROCAL CIRCUIT ELEMENT

BACKGROUND OF THE DISCLOSURE

Field of the Disclosure

The present disclosure relates to a non-reciprocal circuit element, and particularly relates to a non-reciprocal circuit element such as an isolator or a circulator used in the microwave bands.

Description of the Related Art

Hitherto, a non-reciprocal circuit element such as an isolator or a circulator has characteristics of transmitting signals only in a predetermined specific direction and not transmitting signals in the opposite direction. By utilizing the characteristics, for example, the isolator is used for a transmitting circuit unit of a mobile communication apparatus such as a cellular phone.

As such a type of non-reciprocal circuit element, an isolator is known in which, as shown in FIG. 9, on a microwave magnetic material 32 (hereinafter, referred to as ferrite) to which a DC magnetic field G is applied by a permanent magnet, a first center electrode 35 (inductor L1) and a second center electrode 36 (inductor L2) are disposed so as to intersect each other in an insulated state, one end of the first center electrode 35 is an input port P1, the other end of the first center electrode 35 and one end of the second center electrode 36 are an output port P2, a terminal resistor R is connected between the input and output ports P1 and P2 and in parallel with the first center electrode 35, and a capacitance element C11 is connected between the input and output ports P1 and P2 and in parallel with the terminal resistor R. In addition, a capacitance element C2 is connected between the output port P2 and a ground port P3 and in parallel with the second center electrode 36.

The isolator has low insertion loss and is able to operate in a wide band. Patent Document 1 describes a non-reciprocal circuit element that basically has such a circuit configuration to allow isolation characteristics to be adjusted, without deterioration of insertion loss, by making the capacitance element C11 as a variable capacitance element or using a switching element to make a resonance capacitance variable.

Meanwhile, the magnetic permeability of the ferrite and the magnetic force of the permanent magnet have unique temperature characteristics. It is possible to adjust the isolation characteristics of the ferrite and the permanent magnet at normal temperature, but the isolation characteristics are not able to completely follow the characteristics variation caused due to temperature change, and the isolation characteristics and the insertion loss characteristics vary from set values. FIG. 10 shows an example of the characteristics variation caused due to the temperature characteristics of the ferrite and the permanent magnet. In FIG. 10, curves A and A' indicate the isolation characteristics and the insertion loss characteristics at 25° C., curves B and B' indicate the isolation characteristics and the insertion loss characteristics at 85° C., and curves C and C' indicate the isolation characteristics and the insertion loss characteristics at −35° C. That is, in the example shown in FIG. 10, the isolation characteristics shift to the high frequency side when the temperature becomes higher than 25° C., which is normal temperature, and shift to the low frequency side when the temperature becomes lower than 25° C. In addition, in the example shown in FIG. 10, when the temperature becomes higher or lower than 25° C. which is normal temperature, the insertion loss characteristics also vary in accordance with the change in temperature.

The reason why the isolation characteristics deteriorate is that, due to the temperature characteristics of the ferrite and the permanent magnet, the effective values of the inductors L1 and L2 change, so that the resonant frequencies of an LC resonant circuit composed of L1 and C11 and an LC resonant circuit composed of L2 and C2 vary. To prevent this, it is necessary to prepare a magnet and a ferrite having temperature characteristics adjusted to a wide band, or to adjust the capacitance value of the resonant capacitance element C11 such that variation of the resonant frequency is cancelled. However, it is very difficult to prepare materials having temperature characteristics adjusted to the wide band. In addition, temperature detection with high accuracy and capacitance control with respect to the temperature are required for the adjustment of the capacitance element C11, which is not practical.

Patent Document 1: International Publication No. 2012/020613

BRIEF SUMMARY OF THE DISCLOSURE

An object of the present disclosure is to provide a non-reciprocal circuit element that is able to suppress the characteristics variation with respect to temperature without changing a microwave magnetic material or the material of a magnet.

A non-reciprocal circuit element according to a first aspect of the present disclosure includes: a magnetic material to which a DC magnetic field is applied; a plurality of center electrodes disposed on the magnetic material so as to intersect each other in an insulated state; a terminal resistor connected between input and output ports and in parallel with one of the center electrodes; a variable capacitance element connected between the input and output ports and in parallel with the terminal resistor; and a thermistor element connected to a control power supply circuit of the variable capacitance element and in series with the variable capacitance element.

A non-reciprocal circuit element according to a second aspect of the present disclosure includes: a magnetic material to which a DC magnetic field is applied; and a first center electrode, a second center electrode, and a third center electrode disposed on the magnetic material so as to intersect each other in an insulated state, wherein one end of the first center electrode is a first port, one end of the second center electrode is a second port, and one end of the third center electrode is a third port, other ends of the first center electrode, the second center electrode, and the third center electrode are connected to each other and connected to a ground terminal, capacitance elements are connected in parallel with the first center electrode, the second center electrode, and the third center electrode, respectively, a variable capacitance element is connected between the ground terminal and grand and in series with an inductor element, and a thermistor element is connected to a control power supply circuit of the variable capacitance element and in series with the variable capacitance element.

A non-reciprocal circuit element according to a third aspect of the present disclosure includes: a magnetic material to which a DC magnetic field is applied; and a first center electrode, a second center electrode, and a third center electrode disposed on the magnetic material so as to intersect each other in an insulated state, wherein one end of the first center electrode is a first port, one end of the second center electrode is a second port, and one end of the third center electrode is a third port, other ends of the first center electrode, the second center electrode, and the third center electrode are connected to each other and connected to a ground terminal, variable capacitance elements are connected in parallel with the first center electrode, the second center electrode, and the third center electrode, respectively, and a thermistor element is connected to a control power supply circuit of each variable capacitance element and in series with the variable capacitance element.

The non-reciprocal circuit element according to the first aspect is a two-port isolator, and the non-reciprocal circuit elements according to the second and third aspects are three-port circulators. In each of the non-reciprocal circuit elements, by selecting a thermistor element having appropriate temperature characteristics, a voltage required to exhibit a capacitance value for corresponding to temperature change of the variable capacitance element is provided to the variable capacitance element in a state where a control voltage is constant. Accordingly, variation of characteristics with respect to temperature is suppressed, and change of the microwave magnetic material and the material of a magnet or complicated control becomes unnecessary.

According to the present disclosure, it is possible to suppress the characteristics variation with respect to temperature with a simple configuration without changing the microwave magnetic material or the material of the magnet.

DETAILED DESCRIPTION OF THE DISCLOSURE

Figure 1:
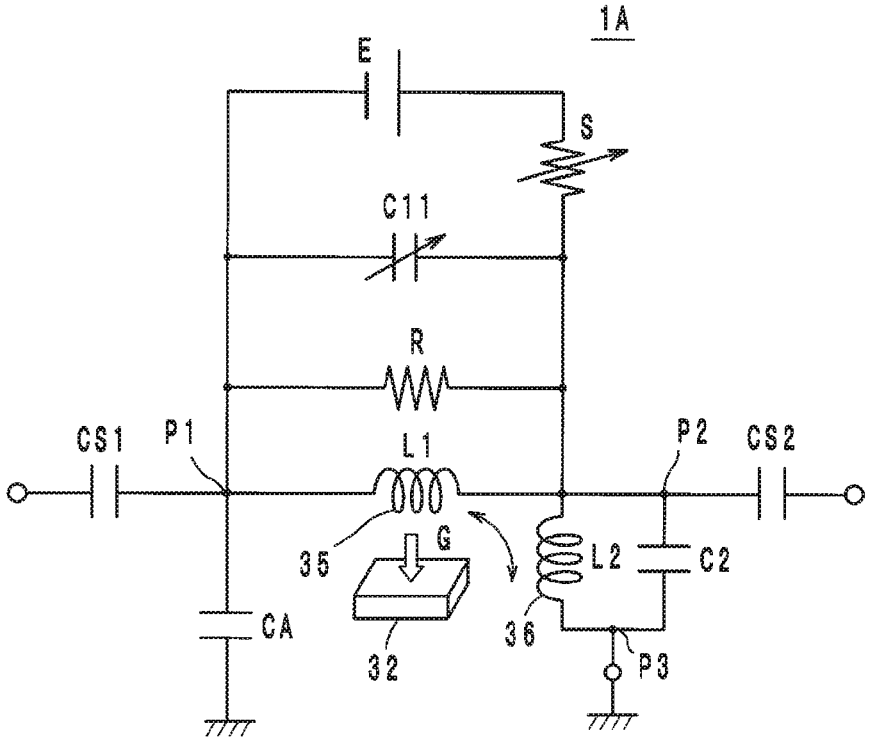
FIG. 1 is an equivalent circuit diagram showing a non-reciprocal circuit element (two-port isolator) according to a first embodiment.

Hereinafter, embodiments of the non-reciprocal circuit element according to the present disclosure will be described with reference to the accompanying drawings. In the respective drawings, the same elements and portions are designated by like reference numerals, and the overlap description is omitted.

(First Embodiment, see FIGS. 1 to 3A and 3B)

A non-reciprocal circuit element 1A according to a first embodiment is a lumped constant type two-port isolator as shown in FIG. 1, and includes a ferrite 32 to which a DC magnetic field G is applied by a permanent magnet that is not shown, and a first center electrode 35 (inductor L1) and a second center electrode 36 (inductor L2) that are disposed on the ferrite 32 so as to intersect each other in an insulated state. The first center electrode 35 has one end connected to an input port P1 and another end connected to an output port P2. The second center electrode 36 has one end connected to the output port P2 and another end connected to a ground port P3. A terminal resistor R is connected between the input port P1 and the output port P2 and in parallel with the first center electrode 35, a variable capacitor C11 is connected between the input port P1 and the output port P2, and a matching capacitor C2 is connected between the output port P2 and the ground port P3 and in parallel with the second center electrode 36.

A capacitor CS1 for matching an input impedance and a grounded capacitor CA are connected to the input port P1, and a capacitor SC2 for matching an output impedance is connected to the output port P2.

Furthermore, a thermistor element S is connected to a control power supply circuit (DC power supply E) of the variable capacitor C11 and in series with the capacitor C11. The capacitance value of the variable capacitor C11 varies in response to change of a voltage applied by the control power supply circuit. A variable capacitance element using a ferroelectric, for example, a BST (barium strontium titanate) element, may be suitably used as the variable capacitor C11.

Figure 2:
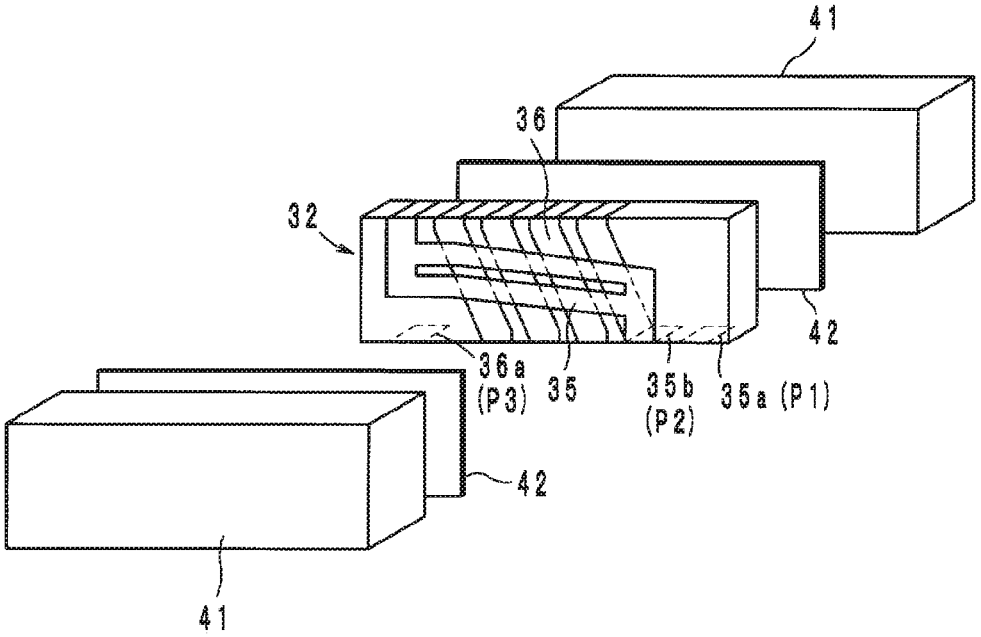
FIG. 2 is an exploded perspective view showing a main part of the non-reciprocal circuit element.

The configuration of a main part of the non-reciprocal circuit element 1A will be described with reference to FIG. 2. A permanent magnet 41 is attached to each of front and back surfaces of the ferrite 32 via an adhesive 42. The first center electrode 35 is wound on the front and back surfaces of the ferrite 32 by one turn, one end electrode 35*a* is the input port P1, and another end electrode 35*b* is the output port P2. The second center electrode 36 is wound on the front and back surfaces of the ferrite 32 by four turns at a predetermined angle with the first center electrode 35 in an insulated state. One end of the second center electrode 36 is shared with the electrode 35*b* (the output port P2), and another end electrode 36a is the ground port P3. In FIG. 2, for avoiding complicatedness, electrodes at the back surface side of the ferrite 32 are not shown.

In the non-reciprocal circuit element 1A, when a high-frequency signal is inputted through the output port P2, the high-frequency signal is attenuated (isolated) by a parallel resonant circuit formed by the first center electrode 35 and the variable capacitor C11. Even when a voltage by the DC power supply E is constant, since the resistance value of the thermistor element S changes in response to temperature, the voltage applied to the variable capacitor C11 changes. Accordingly, characteristics change of the ferrite 32 or the permanent magnet that changes depending on the temperature is compensated for so that variation of the isolation characteristics (variation of the resonant frequency) is cancelled. In addition, the attenuation is adjusted by selecting the impedance of the terminal resistor R.

Meanwhile, during the operation in which a high-frequency current flows from the input port P1 to the output port P2, a large high-frequency current flows through the second center electrode 36, and almost no high-frequency current flows through the terminal resistor R and the variable capacitor C11. Thus, even when the variable capacitor C11 is added, it is possible to neglect loss caused due to the addition of the variable capacitor C11, and the insertion loss does not increase.

Figure 3A:
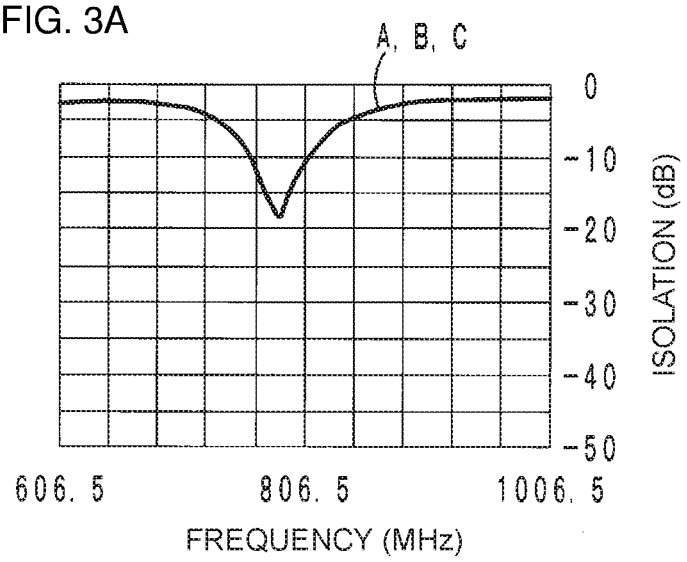
FIG. 3A is a graph showing the isolation characteristics of the non-reciprocal circuit element according to the first embodiment.
Figure 3B:
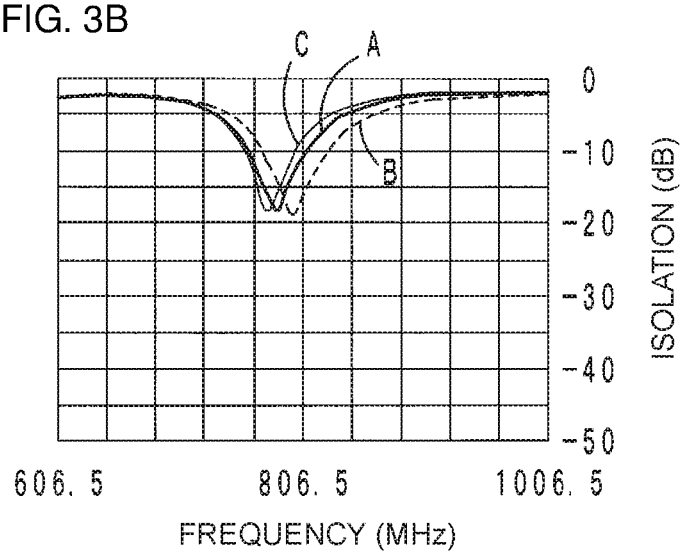
FIG. 3B is a graph showing the isolation characteristics of a comparative example.
Figure 9:
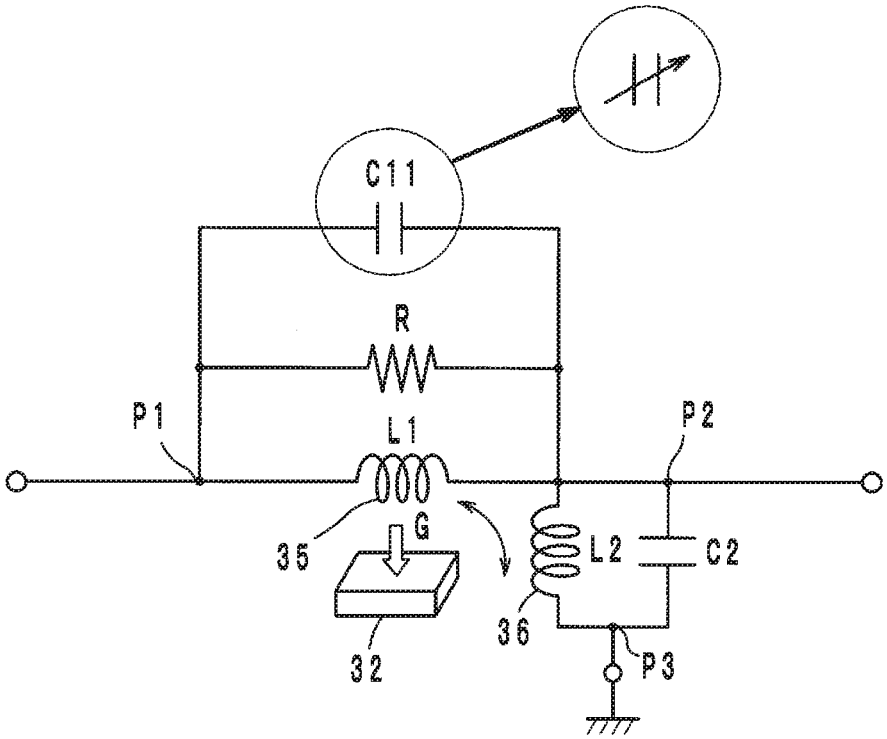
FIG. 9 PRIOR ART
FIG. 9 is an equivalent circuit diagram showing a non-reciprocal circuit element (two-port isolator) according to a related art example.
Figure 10:
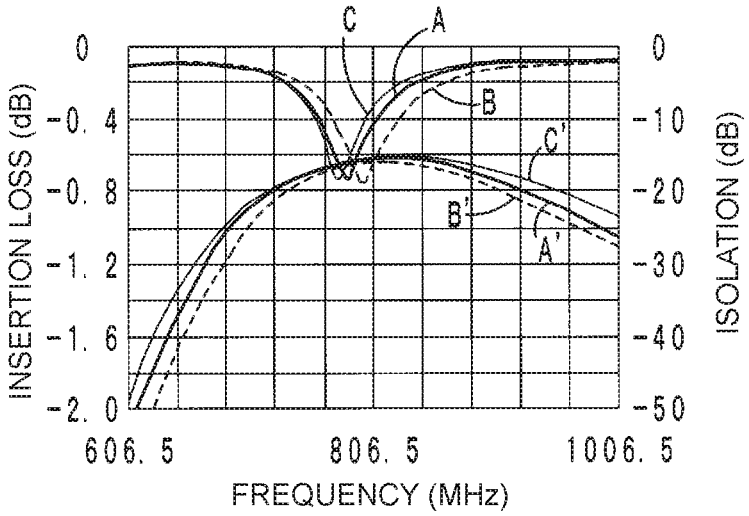
FIG. 10 PRIOR ART
FIG. 10 is a graph showing the isolation characteristics and the insertion loss characteristics of the non-reciprocal circuit element according to the related art example shown in FIG. 9.

Regarding the isolation characteristics of the non-reciprocal circuit element 1A, the curves A, B, and C at 25° C., 85° C., and −35° C. almost overlap each other as shown in FIG. 3A, and almost no variation of the isolation characteristics due to the temperature occurs. For comparison, FIG. 3B shows the isolation characteristics of a two-port isolator in which the element S and the power supply E are omitted. The characteristics in this comparative example are the same as the characteristics shown as the related art example in FIG. 9.

The intersection angle between the center electrodes 35 and 36 is set as necessary, so that the input impedance and the insertion loss are adjusted. In addition, by winding the second center electrode 36 on the ferrite 32 a plurality of times, the inductance of the second center electrode 36 increases, so that the insertion loss decreases and the operating frequency band also expands.

Figure 4:
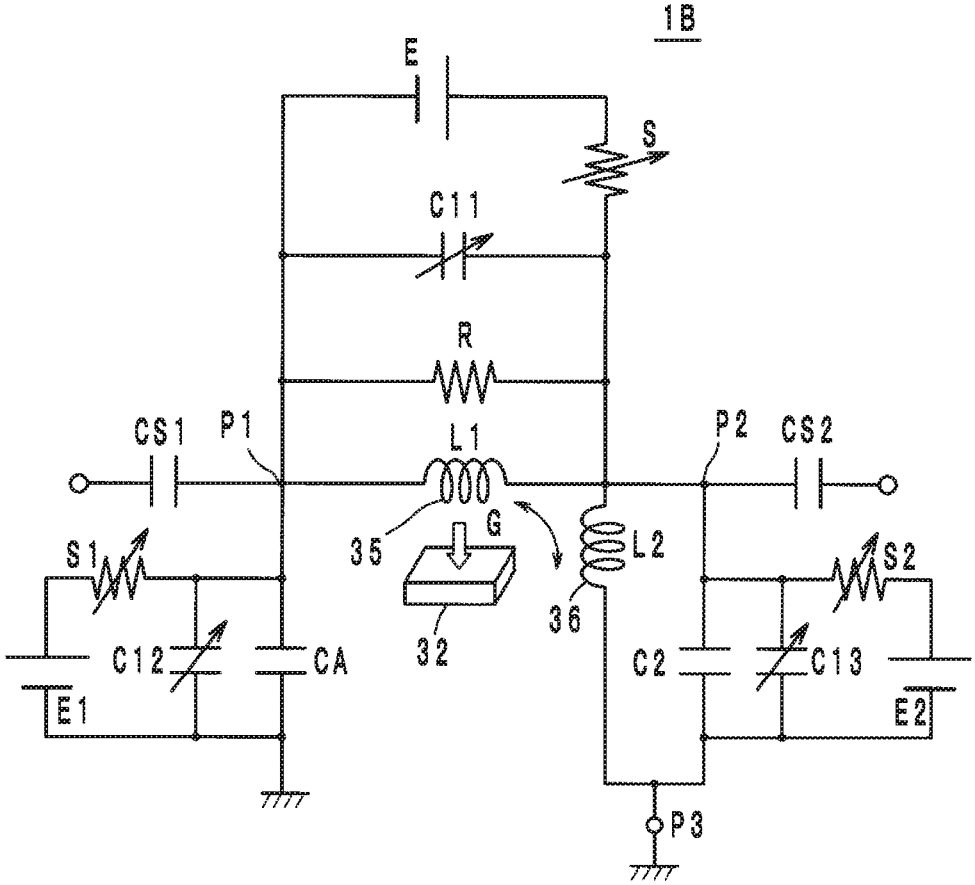
FIG. 4 is an equivalent circuit diagram showing a non-reciprocal circuit element (two-port isolator) according to a second embodiment.
Figure 5A:
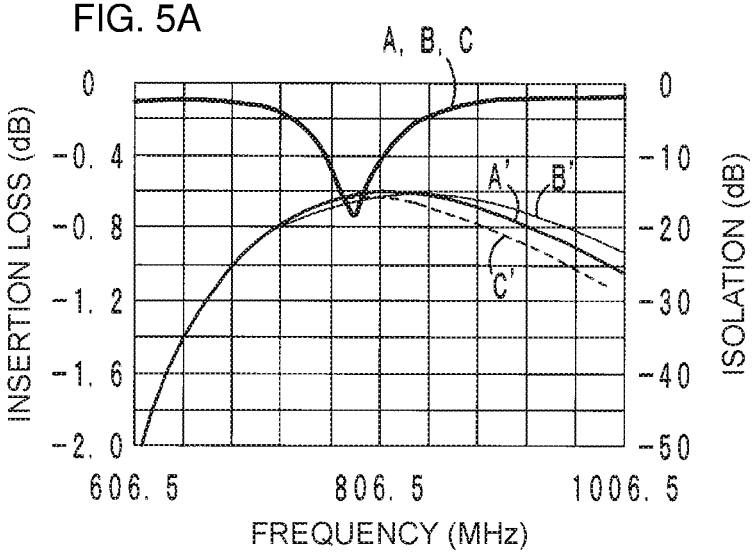
FIG. 5A is a graph showing the isolation characteristics and the insertion loss characteristics of the non-reciprocal circuit element according to the second embodiment.
Figure 5B:
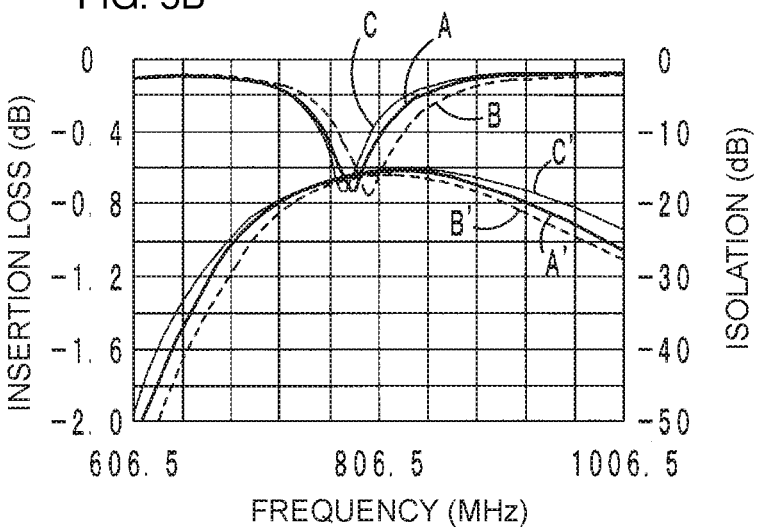
FIG. 5B is a graph showing the isolation characteristics and the insertion loss characteristics of a comparative example.

(Second Embodiment, see FIGS. 4, 5A and 5B)

In a non-reciprocal circuit element 1B (two-port isolator) according to a second embodiment, as shown in FIG. 4, a variable capacitor C12 is connected in parallel with a capacitor CA, and a thermistor element S1 and a DC power supply E1 therefor are connected. Furthermore, a variable capacitor C13 is connected in parallel with a capacitor C2, and a thermistor element S2 and a DC power supply E2 therefor are connected. The other configuration is the same as that of the non-reciprocal circuit element 1A according to the first embodiment. The operation of the isolator and the operations of the variable capacitors C12 and C13 and the thermistor elements S1 and S2 in the second embodiment are basically the same as those in the first embodiment. The capacitors C12 and C13 may be omitted, and the capacitors CA and C2 may be variable capacitors.

By connecting the thermistor elements S1 and S2 in series with the variable capacitors C12 and C13 connected in parallel with the capacitor CA and C2 as in the second embodiment, it is possible to suppress the variation of the isolation characteristics or the variation of the insertion loss characteristics that is caused due to temperature change. As shown by curves A (25° C.), B (85° C.), and C (−35° C.) in FIG. 5A, almost no variation of the isolation characteristics of the non-reciprocal circuit element 1B occurs. In addition, as shown by curves A' (25° C.), B' (85° C.), and C' (−35° C.) in FIG. 5A, almost no variation of the insertion loss characteristics occurs approximately at 780 MHz, which is an operating frequency band, as compared to the related art example. For comparison, FIG. 5B shows the isolation characteristics of a two-port isolator in which the capacitors C12 and C13, the thermistor elements S, S1, and S2, and the power supplies E, E1, and E2 are omitted. The characteristics in this comparative example are the same as the characteristics shown as the related art example in FIG. 9.

Figure 6:
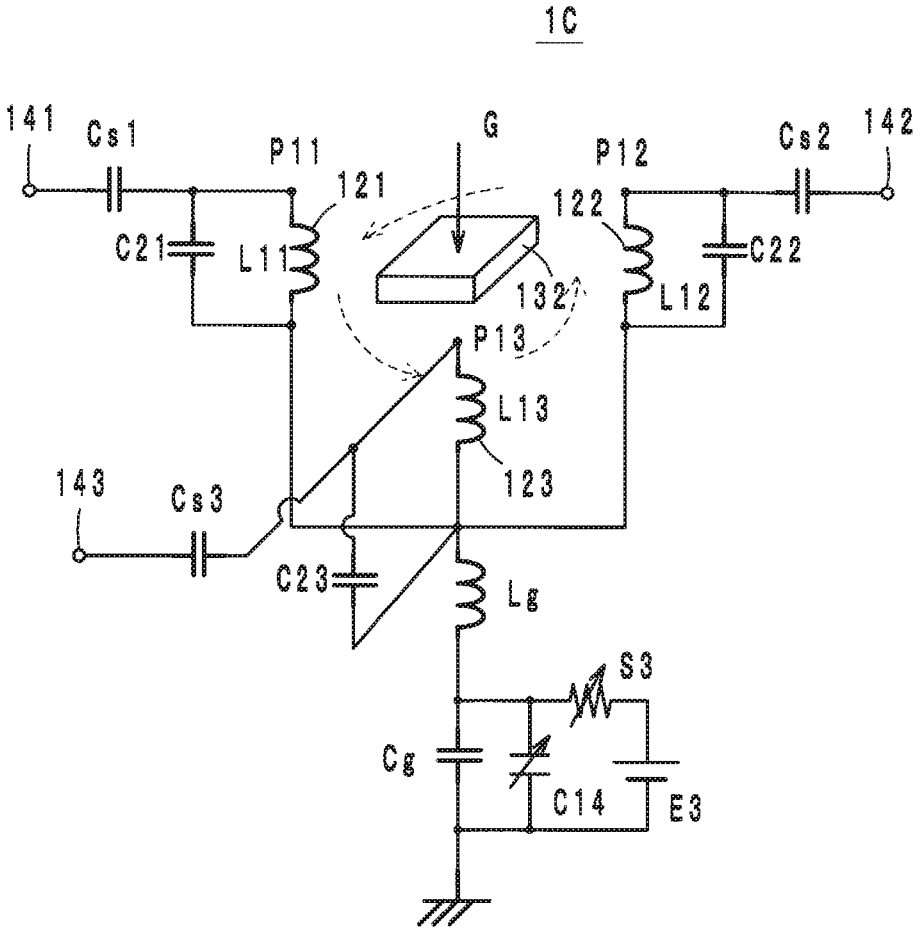
FIG. 6 is an equivalent circuit diagram showing a non-reciprocal circuit element (three-port circulator) according to a third embodiment.
Figure 7A:
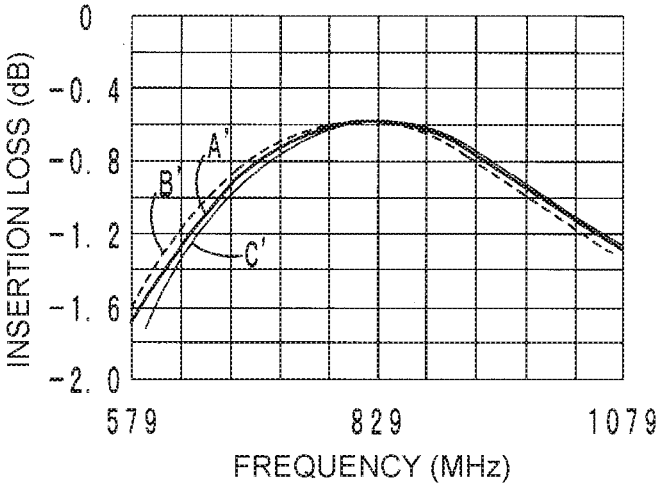
FIG. 7A is a graph showing the insertion loss characteristics of the non-reciprocal circuit element according to the third embodiment.
Figure 7B:
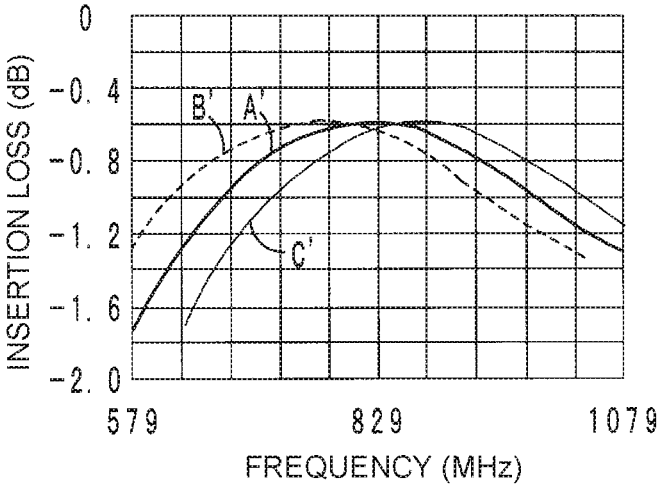
FIG. 7B is a graph showing the insertion loss characteristics of a comparative example.

(Third Embodiment, see FIGS. 6, 7A and 7B)

A non-reciprocal circuit element 1C according to a third embodiment is a lumped constant type three-port circulator having an equivalent circuit shown in FIG. 6. That is, on a ferrite 132 to which a DC magnetic field is applied by a permanent magnet in the direction of an arrow G, a first center electrode 121 (inductor L11), a second center electrode 122 (inductor L12), and a third center electrode 123 (inductor L13) are disposed so as to intersect each other at a predetermined angle in an insulated state, one end of the first center electrode 121 is a first port P11, one end of the second center electrode 122 is a second port P12, and one end of the third center electrode 123 is a third port P13.

The other ends of the respective center electrodes 121, 122, and 123 are connected to each other and are connected to ground via an inductor Lg and a capacitor Cg that are connected in series. Capacitors C21, C22, and C23 are connected in parallel with the center electrodes 121, 122, and 123, respectively. A capacitor Cs1 is connected between the first port P11 and a first terminal 141, a capacitor Cs2 is connected between the second port P12 and a second terminal 142, and a capacitor Cs3 is connected between the third port P13 and a third terminal 143.

Furthermore, a variable capacitor C14 is connected in parallel with the capacitor Cg, and a thermistor element S3 and a DC power supply E3 therefor are connected.

In the three-port circulator according to the third embodiment, a high-frequency signal inputted through the second terminal 142 (second port P12) is outputted from the first terminal 141 (first port P11), a high-frequency signal inputted through a first terminal 141 (first port P11) is outputted from the third terminal 143 (third port P13), and a high-frequency signal inputted through the third terminal 143 (third port P13) is outputted from the second terminal 142 (second port P12).

By connecting the thermistor element S3 in series with the variable capacitor C14 connected in parallel with the capacitor Cg as in the third embodiment, it is possible to suppress the variation of the isolation characteristics or the variation of the insertion loss characteristics that is caused due to temperature change. As shown by curves A' (25° C.), B' (85° C.), and C' (−35° C.) in FIG. 7A, almost no variation of the insertion loss characteristics of the non-reciprocal circuit element 1C occurs. For comparison, FIG. 7B shows the insertion loss characteristics of a three-port circulator in which the thermistor element S3 and the power supply E3 are omitted.

The capacitor C14 may be omitted, and the capacitor Cg may be a variable capacitor.

Figure 8:
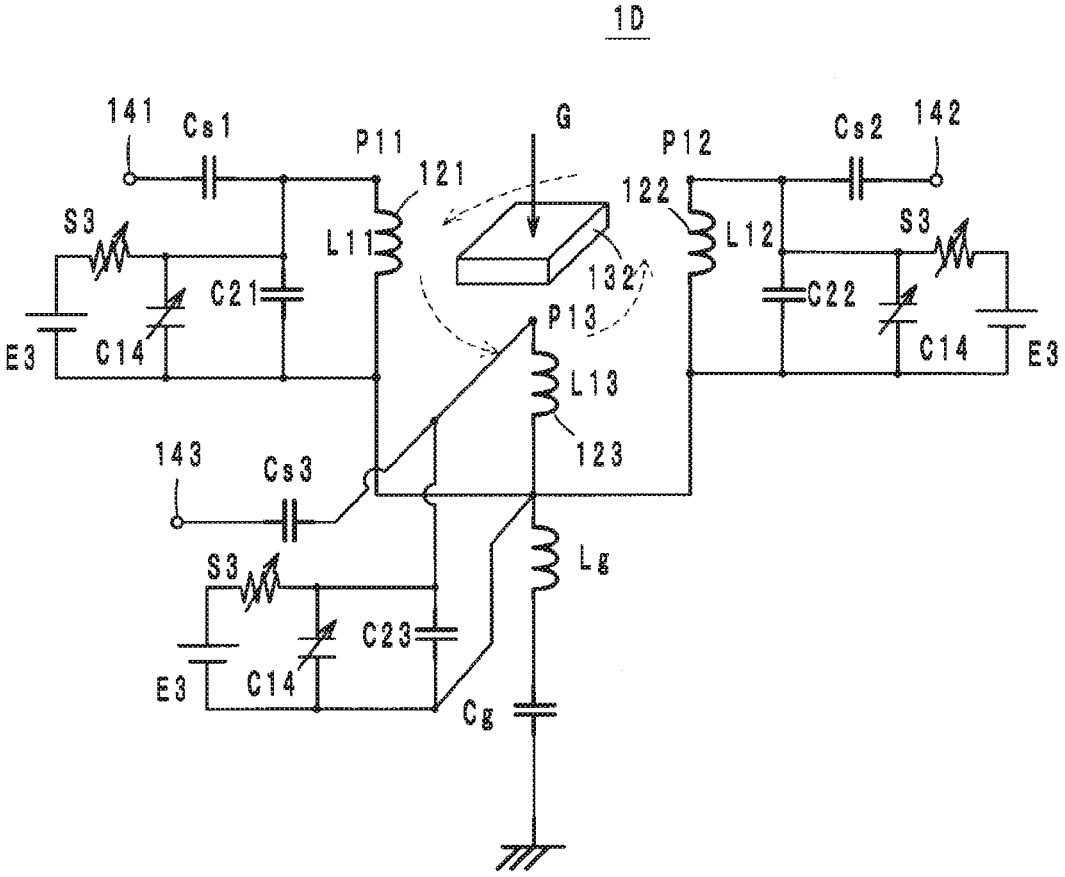
FIG. 8 is an equivalent circuit diagram showing a non-reciprocal circuit element (three-port circulator) according to a fourth embodiment.

(Fourth Embodiment, see FIG. 8)

A non-reciprocal circuit element 1D according to a fourth embodiment is a lumped constant type three-port circulator having an equivalent circuit shown in FIG. 8, and is different from the non-reciprocal circuit element 1C according to the third embodiment only in the following points.

That is, the variable capacitor C14, the thermistor element S3, and the DC power supply E3 with respect to the capacitor Cg are omitted, and these elements C14, S3, and E3 are connected to each of the capacitors C21, C22, and C23. In the fourth embodiment as well, it is possible to suppress the variation of the characteristics of the non-reciprocal circuit element 1D that is caused due to temperature change, similarly as in the first, second, and third embodiments.

(Other Embodiments)

The non-reciprocal circuit element according to the present disclosure is not limited to the embodiments described above, and various changes may be made within the scope of the present disclosure.

For example, when the N pole and the S pole of the permanent magnet are inverted, the input port and the output port are interchanged with each other. The detailed configurations of the ferrite and the permanent magnet and the shape of each center electrode may be variously changed.

INDUSTRIAL APPLICABILITY

As described above, the present disclosure is useful for a non-reciprocal circuit element, and is excellent particularly in that it is possible to suppress the characteristics variation with respect to temperature with a simple configuration.

1A to 1D non-reciprocal circuit element
32 ferrite
35, 36, 121 to 123 center electrode
41 permanent magnet
P1 to P3, P11 to P13 port
C11 to C14 variable capacitor
S, S1, S2, S3 thermistor element
E, E1, E2, E3 power supply
R terminal resistor

The invention claimed is:

1. A non-reciprocal circuit element comprising:
a magnetic material to which a DC magnetic field is applied;
a plurality of center electrodes disposed on the magnetic material so as to intersect each other in an insulated state;
a terminal resistor connected between input and output ports and in parallel with one of the center electrodes;
a first variable capacitance element connected between the input and output ports and in parallel with the terminal resistor;
a control power supply circuit supplying a voltage to the first variable capacitance; and
a first thermistor element connected to the control power supply circuit and in series with the first variable capacitance element,
wherein:
a resistance value of the first thermistor element changes in response to temperature,
a capacitance value of the first variable capacitor varies in response to changes of the voltage supplied by the control power supply circuit, and
the voltage supplied by the power supply circuit changes in response to the resistance value of the first thermistor element.

2. The non-reciprocal circuit element according to claim 1, further comprising a second variable capacitance element and a second thermistor element,
wherein
the output port is connected to ground via the second variable capacitance element, and
the second thermistor element is connected to a control power supply circuit of the second variable capacitance element and in series with the second variable capacitance element.

3. The non-reciprocal circuit element according to claim 1, wherein
the center electrodes include a first center electrode and a second center electrode disposed on the magnetic material so as to intersect each other in an insulated state,
the first center electrode has one end electrically connected to the input port and another end electrically connected to the output port,
the second center electrode has one end electrically connected to the output port and another end electrically connected to a ground port,
the terminal resistor is connected between the input port and the output port, and
the first variable capacitance element is connected between the input port and the output port and in parallel with the terminal resistor.

4. The non-reciprocal circuit element according to claim 3, further comprising a second variable capacitance element and a second thermistor element,
wherein
the input port is connected to ground via the second variable capacitance element, and
the second thermistor element is connected to a control power supply circuit of the second variable capacitance element and in series with the second variable capacitance element.

5. The non-reciprocal circuit element according to claim 3, further comprising a second variable capacitance element and a second thermistor element,
wherein
the output port is connected to ground via the second variable capacitance element, and
the second thermistor element is connected to a control power supply circuit of the second variable capacitance element and in series with the second variable capacitance element.

6. The non-reciprocal circuit element according to claim 1, further comprising a second variable capacitance element and a second thermistor element,
wherein
the input port is connected to ground via the second variable capacitance element, and
the second thermistor element is connected to a control power supply circuit of the second variable capacitance element and in series with the second variable capacitance element.

7. The non-reciprocal circuit element according to claim 6, further comprising a third variable capacitance element and a third thermistor element,
wherein
the output port is connected to ground via the third variable capacitance element, and
the third thermistor element is connected to a control power supply circuit of the third variable capacitance element and in series with the third variable capacitance element.

8. A non-reciprocal circuit element comprising:
a magnetic material to which a DC magnetic field is applied; and
a first center electrode, a second center electrode, and a third center electrode disposed on the magnetic material so as to intersect each other in an insulated state, wherein
one end of the first center electrode is a first port, one end of the second center electrode is a second port, and one end of the third center electrode is a third port,
other ends of the first center electrode, the second center electrode, and the third center electrode are connected to each other and connected to a ground terminal,
capacitance elements are connected in parallel with the first center electrode, the second center electrode, and the third center electrode, respectively,
a first variable capacitance element is connected between the ground terminal and ground and in series with an inductor element,
a first control power supply circuit supplies a voltage to the first variable capacitance,
a first thermistor element is connected to the first control power supply circuit element and in series with the first variable capacitance element,
a resistance value of the first thermistor element changes in response to temperature,
a capacitance value of the first variable capacitor varies in response to changes of the voltage supplied by the first control power supply, and the voltage supplied by the first control power supply circuit changes in response to the resistance value of the first thermistor element.

9. The non-reciprocal circuit element according to claim 8, further comprising second, third and fourth variable capacitance elements; second, third, and fourth control power supply circuits; and second, third and fourth thermistor elements, wherein the second, third, and fourth control power supply circuits supply a voltage to the second, third, and fourth variable capacitance elements, respectively, the second, third, and fourth variable capacitance elements are connected in parallel with the first center electrode, the second center electrode, and the third center electrode, respectively, and the second, third, and fourth thermistor elements are connected to the second, third, and fourth control power supply circuits, respectively, and in series with the second, third, and fourth variable capacitance elements, respectively.

10. A non-reciprocal circuit element comprising:

a magnetic material to which a DC magnetic field is applied; and a first center electrode, a second center electrode, and a third center electrode disposed on the magnetic material so as to intersect each other in an insulated state, wherein one end of the first center electrode is a first port, one end of the second center electrode is a second port, and one end of the third center electrode is a third port, other ends of the first center electrode, the second center electrode, and the third center electrode are connected to each other and connected to a ground terminal, first, second and third variable capacitance elements are connected in parallel with the first center electrode, the second center electrode, and the third center electrode, respectively, first, second, and third control power supply circuits supply a voltage to the first variable capacitance, second variable capacitance, and third variable capacitance, respectively, first, second and third thermistor elements are connected to the first, second, and third control power supply circuits, respectively, and in series with the first, second and third variable capacitance elements, respectively, resistance values of the first thermistor element, the second thermistor element and the third thermistor element change in response to temperature, capacitance values of the first variable capacitor, the second variable capacitor and the third variable capacitor vary in response to changes of the voltage supplied by the control power supply circuit, and the voltage supplied by the control power supply circuit changes in response to the resistance values of the first thermistor element, the second thermistor element, and the third thermistor element.

* * * * *